US008839912B2

(12) United States Patent
Dominguez et al.

(10) Patent No.: US 8,839,912 B2
(45) Date of Patent: Sep. 23, 2014

(54) VIBRATION ISOLATION ASSEMBLY FOR AN ELEVATOR SYSTEM

(75) Inventors: Franck Dominguez, Loiret (FR); Frederic Beauchaud, Coullons (FR); Nicolas Guillot, Coullons (FR)

(73) Assignee: Otis Elevator Company, Farmington, CT (US)

( * ) Notice: Subject to any disclaimer, the term of this patent is extended or adjusted under 35 U.S.C. 154(b) by 648 days.

(21) Appl. No.: 12/992,105

(22) PCT Filed: Aug. 1, 2008

(86) PCT No.: PCT/IB2008/054461
§ 371 (c)(1),
(2), (4) Date: Nov. 11, 2010

(87) PCT Pub. No.: WO2010/013099
PCT Pub. Date: Feb. 4, 2010

(65) Prior Publication Data

US 2011/0061978 A1 Mar. 17, 2011

(51) Int. Cl.
*B66B 11/02* (2006.01)
*B66B 11/08* (2006.01)
*B66B 15/02* (2006.01)

(52) U.S. Cl.
CPC ..... *B66B 11/0206* (2013.01)
USPC ..... 187/266; 187/401; 254/334; 254/392; 254/414

(58) Field of Classification Search
CPC ..... B66B 7/062; B66B 15/02
USPC ..... 187/262, 265, 266, 401, 410; 254/283–286, 326–327, 334–338; 267/151–152, 141.2–141.5, 292, 294; 248/580, 581, 612, 316.8
IPC ..... B66B 7/00,11/08, 11/02, 7/04; F16C 27/06
See application file for complete search history.

(56) References Cited

U.S. PATENT DOCUMENTS

| | | | | | |
|---|---|---|---|---|---|
| 2,034,639 | A | * | 3/1936 | Saurer | 248/612 |
| 2,961,894 | A | * | 11/1960 | Oles | 74/574.4 |
| 4,069,921 | A | * | 1/1978 | Raugulis et al. | 254/337 |
| RE31,525 | E | * | 2/1984 | Boyd et al. | 248/581 |
| 4,658,934 | A | | 4/1987 | Cooper et al. | |
| 4,713,714 | A | * | 12/1987 | Gatti et al. | 360/137 |

(Continued)

FOREIGN PATENT DOCUMENTS

| | | | | | |
|---|---|---|---|---|---|
| DE | 3605270 | A1 | * | 10/1986 | D01H 1/241 |
| EP | 381248 | A2 | * | 8/1990 | F16F 15/12 |

(Continued)

OTHER PUBLICATIONS

AIPN Machine Transation, JP05278974A, Apr. 23, 2013, pp. 1-3.*

(Continued)

*Primary Examiner* — Michael Mansen
*Assistant Examiner* — Stefan Kruer
(74) *Attorney, Agent, or Firm* — Carlson, Gaskey & Olds

(57) ABSTRACT

An exemplary vibration isolation assembly for use with elevators includes a first rigid member having an outer wall at least partially surrounding a central opening. A second rigid member is at least partially received within the central opening of the first rigid member. A resilient layer between the first and second members substantially isolates the first member from vibrations of the second member.

17 Claims, 5 Drawing Sheets

(56) References Cited

U.S. PATENT DOCUMENTS

| | | | | | |
|---|---|---|---|---|---|
| 4,908,929 | A | * | 3/1990 | Fazi et al. | 29/525.13 |
| 5,052,652 | A | | 10/1991 | Sevilleja et al. | |
| 5,213,879 | A | * | 5/1993 | Niwa et al. | 428/213 |
| 5,564,529 | A | | 10/1996 | Ericson et al. | |
| 5,584,364 | A | | 12/1996 | Sakita | |
| 5,611,412 | A | | 3/1997 | Yoo et al. | |
| 5,845,745 | A | | 12/1998 | Lane | |
| 6,405,833 | B1 | * | 6/2002 | Baranda et al. | 187/254 |
| 6,431,325 | B1 | | 8/2002 | Bledsoe et al. | |
| 6,435,314 | B1 | | 8/2002 | Bledsoe et al. | |
| 6,443,266 | B2 | | 9/2002 | Murakami et al. | |
| 7,117,978 | B2 | | 10/2006 | Kaczmarek et al. | |
| 7,225,901 | B2 | | 6/2007 | Mustalahti et al. | |
| 7,383,924 | B2 | | 6/2008 | Izumi et al. | |
| 2002/0100902 | A1 | * | 8/2002 | Strbuncelj et al. | 254/901 |
| 2004/0182979 | A1 | * | 9/2004 | Krzoska et al. | 248/316.8 |
| 2005/0050985 | A1 | | 3/2005 | Crissy | |
| 2006/0175149 | A1 | | 8/2006 | Det et al. | |
| 2008/0289908 | A1 | * | 11/2008 | Murao et al. | 187/266 |

FOREIGN PATENT DOCUMENTS

| | | | | | |
|---|---|---|---|---|---|
| JP | 54115849 | A | * | 9/1979 | B66B 11/08 |
| JP | 1256486 | A | | 10/1989 | |
| JP | 322118 | | | 3/1991 | |
| JP | 04144891 | A | * | 5/1992 | B66B 7/08 |
| JP | 04197978 | A | * | 7/1992 | B66B 7/04 |
| JP | 05278974 | A | * | 10/1993 | B66B 11/08 |
| JP | 2003306281 | A | * | 10/2003 | B66B 7/10 |
| WO | WO 0171219 | A1 | * | 9/2001 | F16H 55/36 |
| WO | 2004048246 | A1 | | 6/2004 | |
| WO | 2006038397 | A1 | | 4/2006 | |

OTHER PUBLICATIONS

International Search Report and Written Opinion of the International Searching Authority for International Application No. PCT/IB2008/054461 mailed Apr. 16, 2009.

* cited by examiner

VIBRATION ISOLATION ASSEMBLY FOR AN ELEVATOR SYSTEM

BACKGROUND

Elevator systems are useful for carrying passengers between different levels in a building, for example. Various challenges are presented to designers of elevator systems. One challenge is maintaining a desired ride quality to provide a comfortable ride for passengers. It is desirable, for example, to minimize vibration of the elevator cab while the elevator car is traveling. Another challenge is presented by the desire to limit the amount of space that an elevator system requires.

The typical approach to minimizing vibration of an elevator cab includes using damping elements between the elevator cab and the supporting frame. Known damping elements comprise rubber pads or blocks that are strategically positioned at various locations of an elevator car structure to dampen vibration of the elevator cab. Such pads or blocks typically are sandwiched between flat surfaces. Example pad configurations are shown in U.S. Pat. Nos. 5,564,529 and 5,052,652.

Recently it has become desirable to minimize the size of the elevator car, itself. A reduced elevator car size, for example, can reduce the amount of space required for the elevator pit. One challenge associated with changing the elevator car design is that it reduces or eliminates the ability to use traditional vibration isolation pads. If an altered elevator car design is to become successful in the marketplace, it must include sufficient vibration isolation to ensure passenger comfort and a desired level of ride quality.

SUMMARY

An exemplary vibration isolation assembly for use with elevators includes a first rigid member having an outer wall at least partially surrounding a central opening. A second rigid member is at least partially received within the central opening of the first rigid member. A resilient layer between the first and second members substantially isolates the first member from vibrations of the second member.

An exemplary elevator car assembly includes a cab. A sheave has a shaft along an axis of rotation of the sheave. A sheave bracket that supports the sheave is mounted for movement with the cab. A vibration damper surrounds the shaft of the sheave for substantially isolating the sheave bracket and the cab from vibration of the sheave.

The various features and advantages of the disclosed example embodiments will become apparent to those skilled in the art from the following detailed description. The drawings that accompany the detailed description can be briefly described as follows.

DETAILED DESCRIPTION

Figure 1:
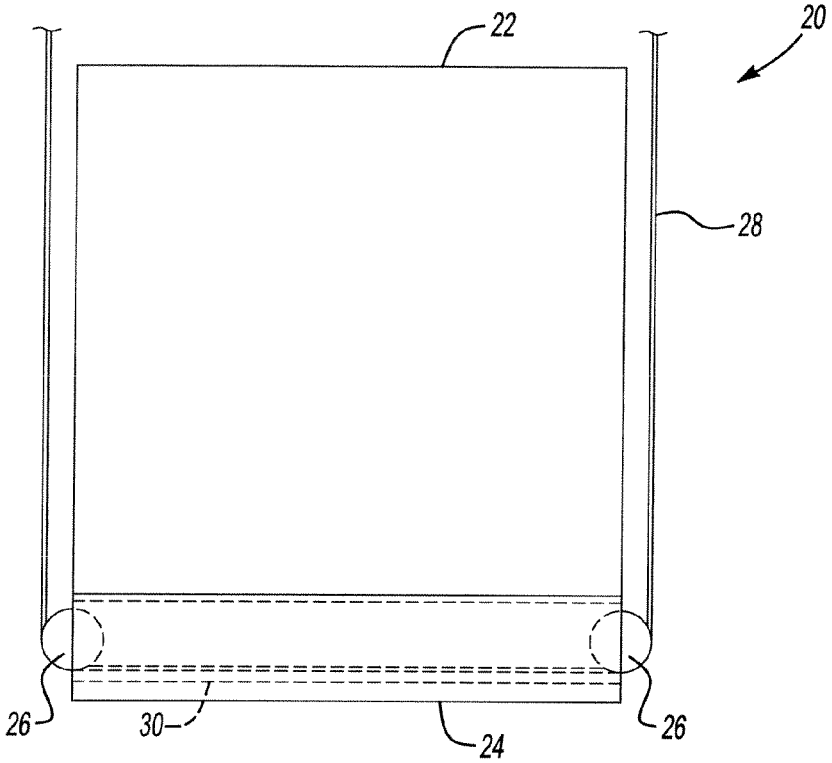
FIG. 1 schematically illustrates selected portions of an example elevator system embodiment.

FIG. 1 schematically shows selected portions of an elevator system 20. An elevator car includes a cab 22 on a supporting frame structure 24. A plurality of sheaves 26 are supported for movement with the elevator car within a hoistway, for example.

The sheaves 26 direct a load bearing assembly 28 underneath the car. The load bearing assembly 28 includes a plurality of tension members such as flat belts or round ropes that support the weight of the elevator car and achieve the desired movement of the car according to known principles of operating traction-based elevator systems.

A support member in the form of a sheave bracket 30 supports the sheaves 26 for movement with the elevator cab 22. The sheave bracket 30 in this example is mounted to a portion of the frame structure 24. The sheave bracket 30 and the sheaves 26 are carried with the elevator cab 22 responsive to movement of the load bearing assembly 28.

In the illustrated example, the sheave bracket 30 supports the sheaves 26 beneath the elevator cab 22 in a so-called underslung configuration. In one example, the sheave bracket 30 is supported on the frame structure 24 such that the sheave bracket does not extend below a lowermost surface on the frame structure 24. This is useful in examples where the frame structure 24 and the elevator cab 22 are integrated into a single structure rather than providing a separately made cab and supporting car frame. In such examples, the space savings realized by integrating the car frame and cab are maintained using the example sheave bracket 30. In another example, separately made car frame and cab structures are utilized and the sheave bracket 30 is supported on an appropriate portion of the car frame.

In another example, the sheave bracket 30 and the sheaves 26 are mounted above or on top of the elevator cab 22.

Figure 4:
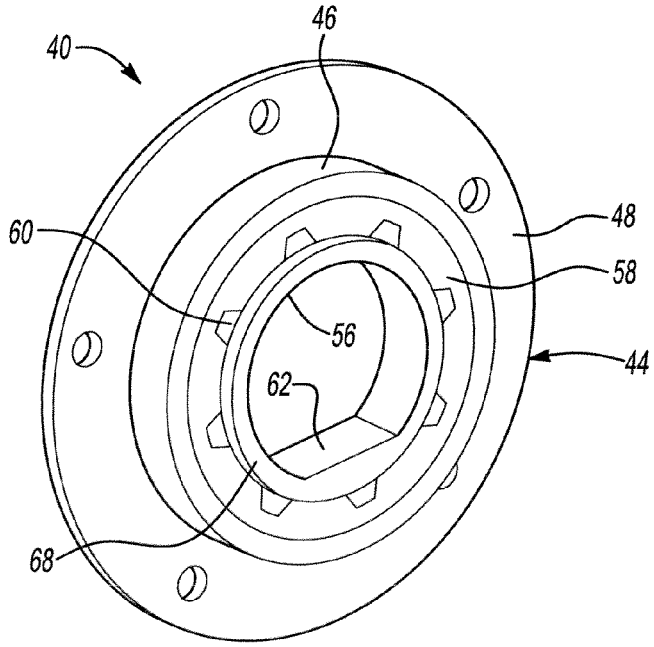
FIG. 4 is a diagrammatic, perspective illustration of selected portions of the example of FIGS. 2 and 3.
Figure 2:
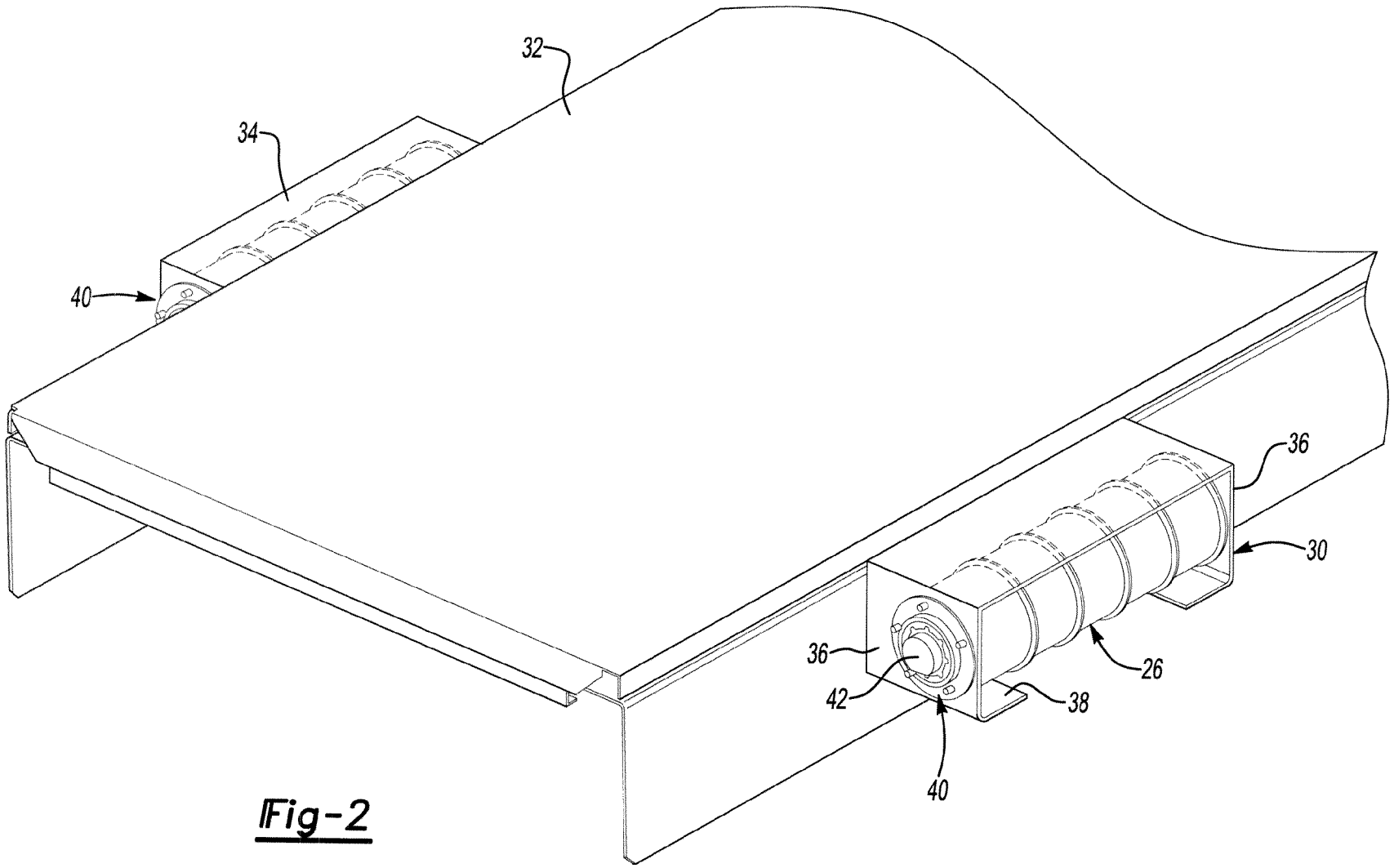
FIG. 2 is a diagrammatic, perspective illustration of selected portions of an example embodiment.
Figure 3:
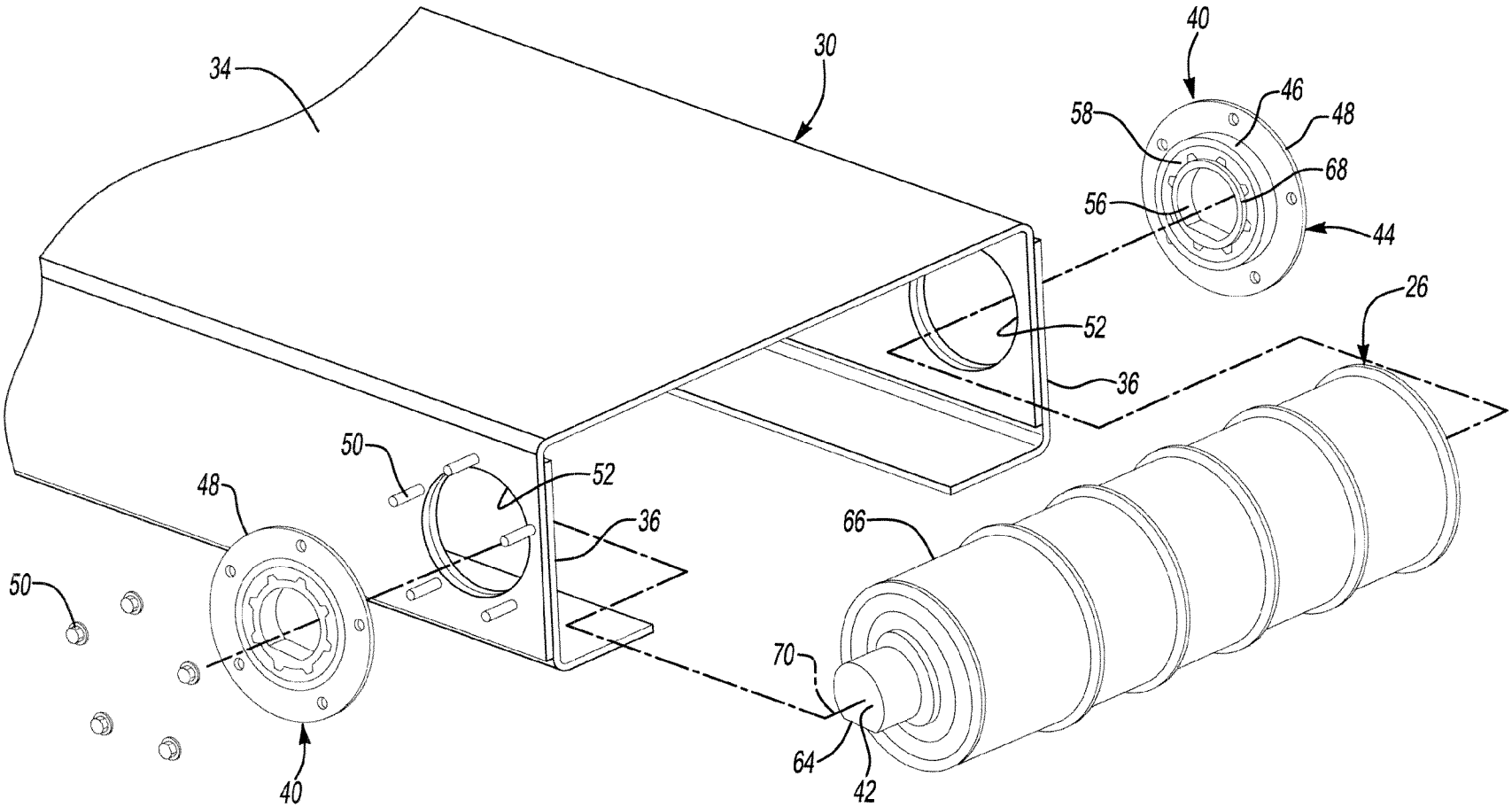
FIG. 3 is a partially exploded view of the example of FIG. 2.

Referring to FIGS. 2-4, one example frame structure 24 includes a floor panel 32 that establishes an orientation of the floor of the elevator cab 22. The sheave bracket 30 includes a panel 34 that is generally planar and oriented parallel with the orientation of the floor of the elevator cab 22 (e.g., the panel 32). A plurality of sidewalls 36 project from edges of the panel 34 in a direction that is generally perpendicular to the plane of the panel 34. In this example, additional side walls 38 project from ends of the sidewalls 36 in a direction generally parallel to the panel 34. As can be appreciated from the illustration, the example sheave bracket 30 establishes a channel within which the sheaves 26 are at least partially received.

Vibration dampers 40 surround a shaft 42 of each sheave 26 and isolate the sheave bracket 30 from vibrations of the sheaves 26. Movement of the elevator car and vibrations in the load bearing assembly 28 can cause vibration of the sheaves 26. The vibration dampers 40 are for substantially isolating any such vibrations from the sheave bracket 30 and, therefore, the remainder of the elevator car structure. By having the vibration dampers 40 at the location of the shaft 42 of the sheaves 26, it is possible to eliminate traditional vibration pads or blocks that were received against a frame member of an elevator car. The location of the vibration dampers 40 in this example is unique, in part, because they surround a portion of the shaft 42 of each sheave 26.

In this example, the vibration dampers 40 include a first rigid member 44 that has an outer wall 46 at least partially surrounding a central opening through the first rigid member 44. In this example, the outer wall 46 is annular and establishes a closed periphery around the central opening. The first rigid member 44 also includes a flange 48 in this example, which facilitates mounting the first rigid member 44 to the sheave bracket 30. In this example, fasteners 50 are utilized for securing the first rigid member 44 in a fixed position relative to the sheave bracket 30. In this example, an outer surface on the outer wall 46 is received within an opening 52 on a sidewall 36 of the sheave bracket 30. In this example, the first rigid member 44 comprises a metal such as steel. There is metal-to-metal contact between the sheave bracket 30 and the first rigid member 44 in this example.

The vibration damper 40 also includes a second rigid member 56 that is at least partially received within the central opening of the first rigid member 44. In this example, the second rigid member 56 is generally annular. The second rigid member in this example comprises a metal such as steel.

The vibration damper 40 includes a resilient layer 58 between the first rigid member 44 and the second rigid member 56. The resilient layer 58 substantially isolates the first rigid member 44 from any vibrations of the second rigid member 56. In this example, the second rigid member 56 is received directly against the shaft 42 of the sheave 26. Therefore, any vibration of the shaft 42 resulting from vibration of the sheave 26 is substantially isolated from the first rigid member 44. It follows that the resilient layer 58 substantially isolates the sheave bracket 30 and the car structure (i.e., car 22 and frame 24) from vibrations of the sheaves 26. In one example, the resilient layer comprises an elastomer. One example elastomer comprises rubber.

The first rigid member 44, the second rigid member 56 and the resilient layer 58 all remain rotationally fixed relative to each other. The illustrated example includes at least one stop surface 60 oriented to engage a corresponding portion of the resilient layer 58 to stop the resilient layer 58 from rotating relative to the second member 56. The resilient layer 58 is also secured in a fixed position relative to the first member 44. In one example, the resilient layer 58 is formed (e.g., molded) onto at least one of the first rigid member 44 or the second rigid member 56 so that all of the components of the vibration damper 40 remain rotationally fixed relative to each other.

The shaft 42 remains rotationally fixed relative to the vibration dampers 40 in this example. Each of the second members 56 includes a flat surface 62 that engages a corresponding flat surface 64 on the shaft 42. As the vibration dampers 40 remain rotationally fixed relative to the sheave bracket 30, the shaft 42 also remains rotationally fixed relative to the sheave bracket 30. The sheave 26 includes a tension member engaging portion 66 that is free to rotate responsive to movement of the load bearing assembly 28. In this example, the second rigid member 56 includes a boss 68 that cooperates with a corresponding surface on the sheave 26 to maintain adequate spacing between the tension member engaging portion 66 of the sheave 26 and the components of the vibration damper 40 and the sheave bracket 30 to allow the desired rotation of the tension member engaging portion 66.

In this example, the sheave 26 has an axis of rotation 70. The first rigid member 44, the second rigid member 56 and the resilient layer 58 are all aligned coaxially with the axis of rotation 70 of the sheave 26. Having the components of the vibration damper 40 coaxially aligned with each other and the axis of rotation 70 of the sheave 26 provides a space-savings configuration that allows for realizing a reduced elevator car footprint, which can be useful for reducing the amount of space required by an elevator system.

Figure 5:
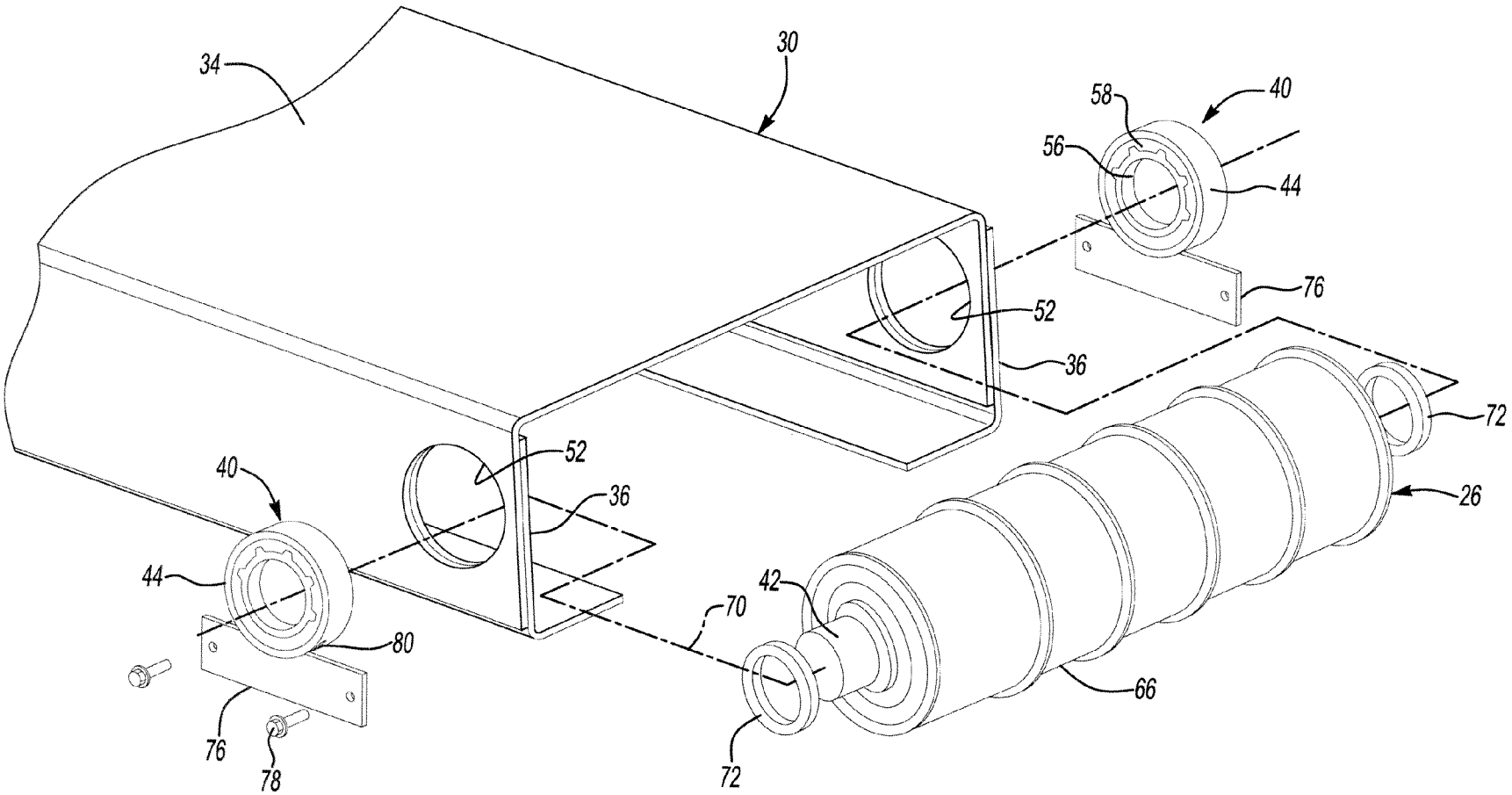
FIG. 5 is an exploded, perspective view of another example embodiment.
Figure 6:
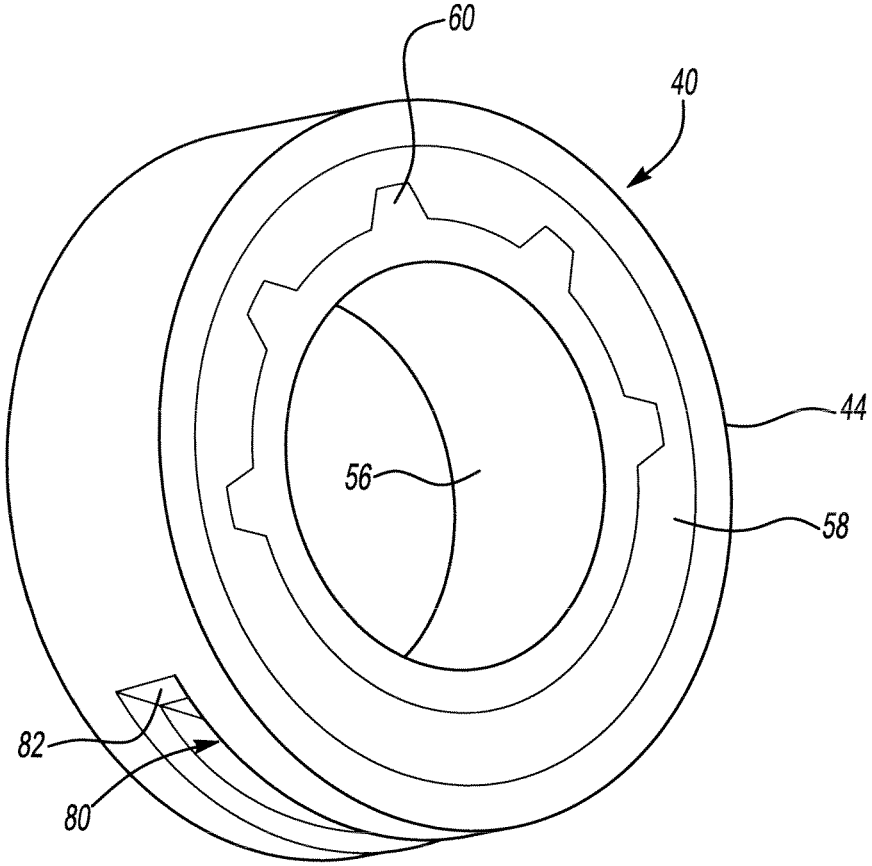
FIG. 6 is a perspective, diagrammatic illustration of selected portions of the example of FIG. 5.

FIGS. 5 and 6 show another example vibration damper configuration. In this example, the second rigid member 56 does not have a boss like the boss 68 in the example of FIGS. 2-4. Instead, a separate spacer 72 is received between the vibration damper 40 and the corresponding surface on the sheave 26.

This example also differs from the previous example in how the vibration damper 40 is secured to the sheave bracket 30. In this example, a key 76 is secured against a corresponding portion of a sidewall 36 of the sheave bracket 30 using fasteners 78. The key 76 is at least partially received within a cutout 80 of the outer wall of the first rigid member 44. The cutout 80 includes at least one reaction surface 82 that engages a portion of the key 76 to hold the first rigid member 44 in a rotationally fixed position relative to the key 76 and, therefore, relative to the sheave bracket 30. The cooperation between the key 76 and the cutout 80 also maintains the first rigid member 44 in an axially fixed position to prevent it from moving relative to the opening 52 within which the outer wall of the first rigid member 44 is at least partially received. In other words, the key 76 and the cutout 80 cooperate to maintain the first rigid member 44 in a position that prevents it from moving along the axis 70 and prevents it from rotation about the axis 70.

In this example, the shaft 42 is press fit into the second rigid member 56 such that there is no relative rotation between them.

[VVon] One example procedure to assemble the illustrated components includes manipulating one end of the shaft 42 into the opening 52 in a sidewall 36 in a manner that results in the shaft 42 and tension member engaging portion 66 being received between the sidewalls 36. The shaft 42 is then aligned with and inserted into the second rigid members 56 as the vibration dampers 40 are placed into the openings 52. The vibration dampers are then secured in place and the sheave bracket 30 can be secured in place relative to the frame structure 24.

The disclosed examples provide a vibration damper and vibration isolation assembly that effectively isolates vibrations of a sheave 26 from a remainder of an elevator car. Having the vibration damper surround the shaft of the sheave 26 allows for strategically placing the shaves relative to the elevator car in a manner that allows for reducing the amount of space occupied by the elevator car and its associated components.

The preceding description is exemplary rather than limiting in nature. Variations and modifications to the disclosed examples may become apparent to those skilled in the art that do not necessarily depart from the essence of this invention. The scope of legal protection given to this invention can no/ybc determined by studying the following claims.

We claim:

1. An elevator car assembly, comprising:

a cab;

a sheave having a shaft along an axis of rotation of the sheave;

a sheave bracket that supports the sheave, the sheave bracket being mounted for movement with the cab; and at least one vibration damper surrounding the shaft of the sheave for substantially isolating the sheave bracket and the cab from vibration of the sheave, the vibration damper comprising:

a first rigid member having an outer wall at least partially surrounding a central opening, the first rigid member contacting the sheave bracket, the first rigid member remaining rotationally fixed relative to the sheave bracket;

a second rigid member at least partially received within the central opening of the first rigid member, the second rigid member at least partially receiving a portion of the shaft of the sheave; and a resilient layer between the first and second members.

2. The assembly of claim 1, wherein the first and second members and the resilient layer are secured together in a manner that prevents relative rotation between any of the first member, the second member and the resilient layer.

3. The assembly of claim 2, wherein the resilient layer is formed onto a surface of at least one of the first member or the second member and secured to the surface.

4. The assembly of claim 2, wherein at least one of the first member or the second member comprises at least one stop surface oriented to engage a corresponding portion of the resilient layer to stop the resilient layer from rotating relative to the at least one of the first member or the second member.

5. The assembly of claim 1, wherein the first and second members comprise metal and the resilient layer comprises an elastomer.

6. The assembly of claim 5, wherein the first and second members comprise steel and the resilient layer comprises rubber.

7. The assembly of claim 1, comprising a key member that remains in a fixed position relative to the sheave bracket and wherein the first member comprises a reaction surface that engages the key for preventing movement of the first member relative to the sheave bracket.

8. The assembly of claim 7, wherein the first member has a cut-out portion and the key is at least partially received in the cut-out portion.

9. The assembly of claim 1, comprising another first member, second member and resilient layer and wherein the shaft of the sheave has two axial ends that are each received at least partially by a corresponding one of the second members.

10. The assembly of claim 1, comprising a load bearing assembly that supports the cab and wherein the sheave bracket is carried with the cab responsive to movement of the load bearing assembly.

11. The assembly of claim 1, wherein the second member is coaxially aligned with the first member and the shaft of the sheave.

12. The assembly of claim 1, wherein the shaft portion is press fit into an interior of the second member to fix the shaft against rotation relative to the second member.

13. The assembly of claim 1, wherein the second member comprises at least one flat surface and the shaft portion comprises a corresponding flat surface that engages the second member flat surface to prevent relative rotation between the shaft portion and the second member.

14. The assembly of claim 1, wherein the second member comprises a boss facing a tension member engaging portion of the sheave for maintaining a spacing between the tension member engaging portion and the first member.

15. The assembly of claim 1, wherein the first member comprises a flange that is received against a surface on the sheave bracket and a plurality of fasteners that hold the flange against the surface on the sheave bracket.

16. The assembly of claim 1, wherein the sheave is positioned above the cab.

17. The assembly of claim 1, comprising a load bearing assembly that supports the cab and wherein the sheave bracket is carried with the cab responsive to movement of the load bearing assembly.

* * * * *